United States Patent [19]

Shoji

[11] Patent Number: 4,639,390

[45] Date of Patent: Jan. 27, 1987

[54] PREPARATION OF NON-WOVEN FABRIC CONTAINING POLYVINYL ALCOHOL FIBER

[75] Inventor: Rikuo Shoji, Moriyama, Japan

[73] Assignee: Firma Carl Freudenberg, Weinheim, Fed. Rep. of Germany

[21] Appl. No.: 794,115

[22] Filed: Nov. 1, 1985

[30] Foreign Application Priority Data

Nov. 27, 1984 [JP] Japan ..... 59-250968

[51] Int. Cl.[4] ..... B32B 3/00

[52] U.S. Cl. ..... 428/195; 156/290; 156/296; 156/308.6; 428/171; 428/288; 428/296; 428/413

[58] Field of Search ..... 156/290, 296, 308.6; 428/171, 195, 288, 296, 913

[56] References Cited

U.S. PATENT DOCUMENTS 4,306,929 12/1981 Menikheim et al. ..... 156/290
4,396,452 8/1983 Menikheim et al. ..... 156/290

FOREIGN PATENT DOCUMENTS 0152953 9/1982 Japan ..... 428/195

*Primary Examiner*—James J. Bell
*Attorney, Agent, or Firm*—Felfe & Lynch

[57] ABSTRACT

The present invention is in a web and method for preparation of non-woven fabric which contains polyvinyl alcohol fiber comprising the steps of forming a web containing scarcely soluble polyvinyl alcohol fiber which is soluble or swellable in the presence of water at a temperature of 90° C. or higher in the amount at least 10% by weight, providing water in said web, and partially thermally bonding the web so that bonded area occupies 5 to 40% of the web area.

18 Claims, No Drawings

PREPARATION OF NON-WOVEN FABRIC CONTAINING POLYVINYL ALCOHOL FIBER

BACKGROUND OF INVENTION

The present invention relates to a method for the preparation of non-woven fabric containing polyvinyl alcohol fiber (PVA fiber), and particularly to a method for preparation of non-woven fabric in which scarcely soluble PVA fiber, which is soluble or swellable in the presence of water at the temperature of 90° C. or higher, is utilized as fibrous binder.

In general two types of PVA fiber are provided, that is, so called soluble PVA fiber which is soluble in water at the temperature of 50° to 80° C. and scarcely soluble PVA fiber which is insoluble or soluble in water only at the temperature of 90° C. or higher. The soluble PVA fiber is dissolved by hot water treatment or steam treatment to exhibit adhesiveness, but on the other hand the scarcely soluble PVA fibers will not be dissolved by these treatments and does not exhibit adhesiveness. Therefore the soluble PVA fiber has been used conventionally to prepare non-woven fabrics which contain PVA fiber as fibrous binder. However non-woven fabrics formed by hot water treating and drying webs comprising soluble PVA fiber and other fibers, such as synthetic fibers and regenerated fibers blended in given proportions, lack softness and exhibit a paper-like feeling. This disadvantage results from the behavior of soluble PVA fiber in bonding that the fiber is dissolved and forms a film-like structure to bond fibers to each other. If the amount of soluble PVA fiber is decreased to obtain softness, the resulting non-woven fabric lacks strength. Furthermore, because soluble PVA fiber is dissolved in water at temperatures as low as 50° to 80° C., when the fiber is subjected to wet heat-treatment, such as a hot water treament, the fiber swells considerably, the strength of the fiber is decreased, and the obtained fabrics lack in water resistivity. Thus these fabrics find limited application.

THE INVENTION

An object of the invention is to eliminate the disadvantages of the above-mentioned prior art and to provide a method for the preparation of non-woven PVA fabric containing fabrics which have softness, strength and an improved water resistivitiy.

The present invention provides a web and method for preparation of non-woven fabric which contains polyvinyl alcohol fiber comprising the steps of forming a web containing scarcely soluble polyvinyl alcohol fiber which is soluble or swellable in the presence of water at a temperature of 90° C. or higher in the amount at least 10% by weight;

providing water in said web, and partially thermally bonding the web so that bonded area occupies 5 to 40% of the web area.

Strong bonding is formed in the bonded region and bulkiness is provided in the non-bonded region in a non-woven fabric in accordance with the present invention. Thus a fabric which has both strength and softness is obtained. The scarcely soluble PVA fibers which are distributed in the non-bonded region and do not contribute to the bonding, do not swell or dissolve when subjected to the hot wet treatment. In contrast to soluble PVA fibers, the fibers maintain their original strength. The bonded region will not be sensitive to water once the bonded region is formed, and the water resistivity increases.

The scarcely soluble PVA fiber used in the present invention dissolves in water at a temperature of 90° C. or higher, was subjected to heat-treatment and suitably combined by acetalization. That is, PVA fiber which was heat-treated after spinning or was subsequently acetalized, is used. The acetalization process is a chemical reaction wherein aldehydes, ketones or other chemical compounds with carboxyl groups are used to convert a (poly-) alcohol into its dialkoxylated form of the general formula

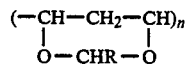

under separation of $H_2O$. This procedure leads to reticulated polymers and is well known and widely used in PVA fiber treatment. PVA fiber which is subjected to only heat-treatment dissolves in water at a temperature of 95° to 100° C. Fiber which is additionally subjected to acetalization dissolves in water at the temperature of 100° C. or higher or is insoluble. Therefore successively heat-treated and acetalized scarcely soluble PVA fiber is preferably used if the fiber strength and water resistivity are especially required. However, successively heat-treated and acetalized PVA fiber which is severely treated so that it does not exhibit adhesiveness, even when it is heat-pressed at a temperature of about 220° C. after providing water, is not suitable for use as the fibrous binder according to the present invention.

The above-mentioned web which contains scarcely soluble PVA fiber may be formed by known web formers such as a carding machine. The web should contain at least 10% by weight of the scarcely soluble PVA fiber. If the amount of scarcely soluble fiber is less, a non-woven fabric of reduced strength results. To obtain a non-woven fabric of improved strength, 20% by weight or more of scarcely soluble PVA fiber is preferably contained. Various synthetic fibers such as polyester, polyamide, polyacrylonitrile fiber and cellulosic regenerated fiber are blended in the web in cooperation with scarcely soluble PVA fiber. Cellulose fiber especially has increased affinity with water and is subject to swelling and plasticization. Hence the web is relatively non-sensitive to the partial heat-pressing and resistant to cleavage and damage in contrast with performing the operation in a dry condition. Thus a non-woven fabric according to the present invention which contains both scarcely soluble PVA fiber and cellulose fiber cooperatively exhibits reduced dust releasing properties such that a non-woven fabric of the invention is preferably used for sanitary materials, floppy disk liners, and in such other applications where trace amounts of dust result in adverse consequences.

Water is provided to the web to establish a water content of 20 to 300% using a spray or padder. The water content of 20% to 300% is based on the weight of the dry PVA fiber. If the water content is less than 20% the scarcely soluble PVA fiber is not sufficiently plasticized and sufficient bonding strength can not be obtained. On the other hand, if the water content exceeds 300%, the temperature is apt to decrease and the workability is adversely affected due to excessive water. An especially preferred range of water content is 60 to 200%.

Warm water, hot water or steam may be used as the circumstances require. Additional functional characteristics can be obtained by adding various additives such as antistatic or antiseptic agents, adhesives, and perfumes.

After water is provided, the web is heat-pressed by a surface embossed embossing roll. Temperature and pressure conditions are selected so that the scarcely soluble PVA fiber exhibits adhesiveness by dissolving or highly swelling, i.e. a temperature of 150° to 230° C. and linear pressure of 20 to 60 kg/cm to obtain a non-woven fabric of increased strength and improved quality.

EXAMPLE

A web with a basis weight of 50 g/cm$^2$ was formed of 30% by weight of PVA fiber having a strength of 3.5 cN/dtex, a denier of 1.5 and length of 38 mm dissolved in water at a temperature of 130° C., heat-treated after spinning and subsequently partially acetalized, and of 70% by weight of rayon fiber with a denier of 2 and length of 51 mm. Water was then provided to the web by a padder so that the water content was controlled to 120%. Subsequently, the web was heat-pressed by an embossing calendar which was diagonally patterned with a projected area of 24%. The temperature was 205° C. and the linear pressure was 20 to 60 kg/cm. Water was removed in a hot air dryer to obtain the non-woven fabric which had increased strength and improved softness.

The non-woven fabric of the present invention is prepared by using scarcely soluble PVA fiber which is soluble or swellable at the temperature of 90° C. or higher in the presence of water as the fibrous binder, hence the obtained fabric has significantly improved water resistivity in addition to improved softness and strength.

In addition, if a web formed of scarcely soluble PVA fiber and rayon fiber cooperatively is used, a non-woven fabric, additionally having excellent dust releasing properties due to the cleavage and damage of fibers caused from partially heat-press treatment can be obtained. Therefore the present invention provides a useful method for preparation of non-woven fabrics which are suitable for use as sanitary materials and floppy disk liners.

It will be understood that the specification and examples are illustrative but not limitative of the present invention and that other embodiments within the spirit and scope of the invention will suggest themselves to those skilled in the art.

I claim:

1. A method for preparation of non-woven fabric which contains polyvinyl alcohol fibers comprising:

forming a web containing slightly soluble polyvinyl alcohol fiber which is soluble or swellable in the presence of water at a temperature of 90° C. or higher in the amount of at least 10% by weight;

providing water in said web to obtain a water content of at least 20% by weight; and partially thermally bonding the web so that the bonded area occupies 5 to 40% of the web area.

2. The method of claim 1 wherein the web is additionally formed of a synthetic fiber.

3. The method of claim 2 wherein the synthetic fiber is selected from the group consisting of polyester, polyamide, polyacrylonitrile fiber, and cellulosic regenerated fiber.

4. The method of claim 2 wherein the synthetic fiber is rayon.

5. The method of claim 1 wherein the PVA fiber is heat-treated and suitably combined by acetalization.

6. The method of claim 1 wherein the water provided to said web is such that the water content of the web does not exceed 300% by weight.

7. The method of claim 1 wherein the water content of the web is from 60 to 200% by weight.

8. A partially thermally bonded web comprising slightly soluble polyvinyl alcohol fiber which is soluble or swellable in the presence of water at a temperature of 90° C. or higher in the amount at least 10% by weight wherein the bonded area of the web occupies 5 to 40% of the web area.

9. The web of claim 8 further comprising a synthetic fiber.

10. The web of claim 8 wherein the synthetic fiber is polyester.

11. The web of claim 9 wherein the synthetic material is rayon.

12. The web of claim 9 wherein the PVA fiber is heat-treated and suitably combined by acetalization.

13. The web of claim 9 wherein the water content of the web is at least 20% by weight.

14. The web of claim 8 including additives.

15. The web of claim 8 wherein the synthetic fiber is polyamide.

16. The web of claim 8 wherein the synthetic fiber is polyacrylonitrile fiber.

17. The web of claim 8 wherein the synthetic fiber is cellulosic regenerated fiber.

18. The web of claim 9 wherein the synthetic fiber is a blend of fibers selected from the group consisting of polyester, polyamide, polyacrylonitril fiber and cellulosic regenerated fiber.

* * * * *